US010442571B2

(12) United States Patent
Huizingh et al.

(10) Patent No.: US 10,442,571 B2
(45) Date of Patent: Oct. 15, 2019

(54) DISPLAY CONTAINER

(71) Applicant: IFCO Systems GmbH, Pullach (DE)

(72) Inventors: John Huizingh, Vlagtwedde (NL); Richard Kellerer, Feldkirchen (DE)

(73) Assignee: IFCO SYSTEMS GMBH, Pullach (DE)

( * ) Notice: Subject to any disclaimer, the term of this patent is extended or adjusted under 35 U.S.C. 154(b) by 8 days.

(21) Appl. No.: 15/646,387

(22) Filed: Jul. 11, 2017

(65) Prior Publication Data

US 2017/0305598 A1 Oct. 26, 2017

Related U.S. Application Data

(63) Continuation of application No. PCT/EP2016/051277, filed on Jan. 22, 2016.

(30) Foreign Application Priority Data

Jan. 22, 2015 (DE) ..... 10 2015 100 886

(51) Int. Cl.

| | |
|---|---|
| ***B65D 25/00*** | (2006.01) |
| ***B65D 1/22*** | (2006.01) |
| ***B65D 6/00*** | (2006.01) |
| ***B65D 1/40*** | (2006.01) |

(52) U.S. Cl.

CPC ..... *B65D 25/005* (2013.01); *B65D 1/225* (2013.01); *B65D 1/40* (2013.01); *B65D 11/20* (2013.01)

(58) Field of Classification Search

CPC ..... B65D 25/005; B65D 90/021; B65D 2519/00805; B65D 1/225; B65D 1/243; B65D 2501/24133

See application file for complete search history.

(56) References Cited

U.S. PATENT DOCUMENTS 1,682,511 A * 8/1928 Haug ..... B02C 15/16 241/167
4,726,486 A * 2/1988 Masuda ..... B65D 88/524 220/1.5
5,570,801 A * 11/1996 Younger ..... B65D 88/14 160/328
6,305,566 B1 10/2001 Pigott et al.
(Continued)

FOREIGN PATENT DOCUMENTS

DE 1 927 602 A1 2/1971
DE 71 46 790 U 2/1977
(Continued)

OTHER PUBLICATIONS

Official Communication issued in International Patent Application No. PCT/EP2016/051277, dated Mar. 14, 2016.

*Primary Examiner* — Shawn M Braden
(74) *Attorney, Agent, or Firm* — Keating & Bennett, LLP

(57) ABSTRACT

What is disclosed is a container for transporting and storing goods, having a floor and side walls extending from the floor. In accordance with the invention, at least one of the side walls or a part thereof is formed by a grid-like structure which is extensible and compressible or able to be pulled apart and squeezed together at least in one direction and within the side wall plane so as to demarcate or to close the container toward the side in a first position and to release the container toward the side in a second position.

10 Claims, 3 Drawing Sheets

(56) References Cited

U.S. PATENT DOCUMENTS

| | | | | |
|---|---|---|---|---|
| 2004/0020821 | A1 | 2/2004 | Koefelda et al. | |
| 2005/0051544 | A1* | 3/2005 | Looker | B65D 88/14 220/1.5 |
| 2008/0142530 | A1 | 6/2008 | Meers et al. | |
| 2010/0122981 | A1* | 5/2010 | Sims | F16K 27/067 220/1.6 |
| 2010/0147840 | A1 | 6/2010 | Dowd | |
| 2013/0175912 | A1 | 7/2013 | Bradford et al. | |
| 2015/0013614 | A1 | 1/2015 | Salzmann | |

FOREIGN PATENT DOCUMENTS

| | | | |
|---|---|---|---|
| DE | 80 16 441 | U1 | 10/1980 |
| DE | 35 05 338 | A1 | 8/1986 |
| DE | 10 2006 049 199 | A1 | 4/2008 |
| DE | 10 2013 107 441 | A1 | 1/2015 |
| EP | 0 236 514 | A1 | 9/1987 |
| EP | 0 835 816 | A2 | 4/1998 |
| EP | 2 078 679 | A1 | 7/2009 |
| GB | 2 068 338 | A | 8/1981 |
| GB | 2 449 757 | A | 12/2008 |
| WO | 94/10049 | A1 | 5/1994 |
| WO | 2011/048259 | A1 | 4/2011 |
| WO | 2011/131301 | A1 | 10/2011 |

* cited by examiner

DISPLAY CONTAINER

This application is a continuation of copending International Application No. PCT/EP2016/051277, filed Jan. 22, 2016, which is incorporated herein by reference in its entirety, and additionally claims priority from German Application No. 10 2015 100 886.6, filed Jan. 22, 2015, which is also incorporated herein by reference in its entirety.

The present invention relates to a container for transporting and storing goods in accordance with the preamble of claim 1. In particular, the invention relates to a display container for presenting goods.

BACKGROUND OF THE INVENTION

It is typically inside transport containers or boxes that goods are delivered to retailers, where they are moved from the transport containers to shop shelves. Instead of removing the goods from the transport containers and placing them into shop shelves and thus presenting them to the customers, there has been an increasing tendency in recent years, for reasons of cost and space, to present the goods to the customers while leaving them in entire batches or stacks of goods or even leaving them inside the transport crates. Since a multitude of goods are sold in pouches, cardboard packaging, etc. that may easily be damaged during transport, the transport crates must fully protect the delivered goods, from all sides if possible, from force effects from the outside. In addition, said transport crates themselves must have a low net weight only and should be compactable in the empty state to be able to be temporarily stored or transported back in a space-saving manner. For this purpose, collapsible or foldable plastic containers are typically used. However, said containers' suitability for presenting goods for sale is limited since the side walls which protect the goods from all sides during transport also conceal the goods.

When a side wall is omitted with for presentation purposes, as is proposed in documents U.S. Pat. No. 6,305,566 B1 and WO 2011/048259 A1, there is a risk that during transport, the goods may fall out from or be damaged on the very side of the omitted side wall. The same applies to the container described in GB 2 449 757 A, wherein as one side wall, merely a frame is provided which comprises a large display opening, or to the container of EP 0 835 816 A2, wherein a U-shaped recess is provided in the side wall. In other systems known from GB 2 068 338 A or WO 94/10049 A1, at least one side wall is outwardly collapsible. However, this involves a corresponding space requirement to the side and/or to the front, which is why said containers cannot be stacked in close vicinity to one another or why folded-back side walls conceal the goods containers stacked thereunder. Compromises that are also not convincing are presented by the systems of US 2008/142530 A1 and US 2004/020821 A1, wherein the side wall is subdivided into several segments and wherein an upper half, or two thirds, of a side wall can be outwardly folded back, or the systems of US 2008/142530 A1 and US 2010/147840 A1, wherein the side walls can be completely removed, which in turn raises the question as to what is to be done with the removed side walls, or where they are supposed to be temporarily stored.

From WO 2011/131301 A1, a container is known which might fundamentally be suitable for the above-described purpose of application since one of the four side walls can be removed. With this container, the removed and loose side wall can be temporarily stored within an accommodation recess specifically provided for this purpose in the floor area. However, this results in the disadvantage that due to the stowage space, the container has a larger total height and thus has a larger space requirement both in the shelf and in the return transport in the empty state.

SUMMARY

An embodiment may have a container, in particular display container, for transporting and storing or presenting goods, comprising a floor which is essentially rectangular, in particular, and side walls extending from the floor, characterized in that at least one of the side walls, in particular a longitudinal side wall, or a part thereof is formed by a grid-like structure which is extensible and compressible or able to be pulled apart or squeezed together in at least one, in particular vertical, direction and in the side wall plane so as to demarcate or to close the container toward the side in a first position and to release the container toward the side in a second position; characterized in that the at least one side wall is formed by the grid-like structure alone, outer end portions of the strips each being movably accommodated within a guide slot of a correspondingly adjacent side wall.

The inventive container is suitable for transporting and storing goods. It may be, in particular, a so-called display container suitable for presenting goods. The container comprises a floor, which is essentially rectangular, in particular, and side walls extending from the floor. At least one of the side walls, in particular a longitudinal side wall, or a part thereof, is formed by a grid-like structure. Said grid-like structure is extensible and compressible, or able to be pulled apart and squeezed together, in at least one direction, advantageously a vertical direction, or a direction perpendicular to the floor face, and in the side wall plane so as to demarcate or to close the container toward the side in a first position and to release the container toward the side in a second position. In other words, in the first position the grid-like structure safeguards the goods inside the container, in particular during transport or handling of the container, and in the second position it enables unimpeded viewing of the goods from this side and also removal of the goods from the container on this side.

This yields a solution that is logistically optimized and is space-saving for the market. The opened front side provides unimpeded view and/or unimpeded access to the goods. Since the grid-like structure can be pulled apart and squeezed together within the side wall plane, i.e. since its extension can be lengthened or shortened in at least this one direction, no space at all is involved for opening the side wall, neither toward the inside nor toward the outside. Also, no stowage space is needed in the container floor, as is the case, e.g., in the container of WO 2011/131301 A1, so that as compared to said latter container, the height can be reduced, or the loading volume of the container can be maximized.

In accordance with the invention, it is possible that only one of the side walls comprises such a grid-like structure; however, it is advantageously also possible for two mutually opposite sides of the container to comprise such an extensible and compressible grid (sliding) impression, so that with this container, the goods can be presented toward both sides. In accordance with one embodiment, it is also possible for all of the side walls, in particular all four side walls, to be provided with such a grid structure.

With an extensible and compressible grid-like structure, or a grid-like structure that can be pulled apart and squeezed together, the material is strained (collapsed or folded) at predetermined joint or hinge locations only and is not exposed to any extension or compressive strain apart from that. This is why the individual structural elements forming the grid-like structure may be provided with a higher bending and buckling strength so as to thus cope with the daily strains to which such a transport and display container is exposed. Thus, in accordance with one aspect of the invention, selected braces or structural elements of the grid structure comprise joint portions for pulling the grid structure apart and squeezing it together.

In accordance with one aspect of the invention, the grid-like structure is formed in one piece, in particular of plastic. This simplifies not only its manufacture, but also the assembly of the container. Another essential advantage of being formed in one piece is to be seen in that the degrees of freedom of the individual elements of the grid structure and/or their relative motion are limited and defined. This is why no jams at all can occur, as typically is the case with loosely cooperating gliding elements. Thus, handling of the container when opening and/or compressing the grid structure and closing the side wall and/or pulling apart the structure is simplified. If the grid-like structure is formed of plastic in one piece, it can be manufactured by injection molding in a simple manner and, above all, at low cost.

In accordance with one aspect of the invention, the grid-like structure is formed by a multitude of strips essentially extending in parallel and of connecting portions arranged between the strips. The strips extend perpendicularly or transversely to the actuating direction of the grid-like structure, i.e. horizontally in the case of a grid that can be actuated, or is extensible and compressible, in the vertical direction, and vertically in the case of a grid that can be actuated, or is extensible and compressible, in the horizontal direction (laterally to the left or right). The connecting portions arranged between adjacent strips are configured such that they can be bent or folded within the side wall plane, i.e. comprise corresponding joint portions, so as to thus decrease and/or re-increase the distance between two adjacent strips when the compressed grid is pulled apart again. Therefore, the connecting portions are responsible, or decisive, for changing the length of the grid-like structure. Advantageously, several such connecting portions are arranged between respectively adjacent strips. In particular, these are arranged such that they are equally distributed, or equally spaced apart, so as to ensure uniform compression and/or extension of the grid structure. In accordance with one embodiment, the connecting portions between a pair of adjacent strips may be offset in the transverse direction from another adjacent pair of strips.

In accordance with one aspect, the grid-like structure may comprise a reinforced and/or straight-line end strip at the upper and/or lower end(s) when the grid-like structure is movable in the vertical direction, or at the left and/or right end(s) when the grid-like structure is movable in the lateral direction. Said end strip may be used for improved handling of the grid-like structure and also increases its strength.

In accordance with one aspect, each connecting portion may consist of two connecting segments which are of equal length, in particular, and which are centrally connected to each other via a living hinge so as to fold the two to connecting segments up and apart. The swivel axis of the living hinges extends in an axis perpendicular to the side wall plane. The connecting segments for their part are also connected to the corresponding, e.g. upper and lower, edge via living hinges so as to thus be swiveled toward or away from the respective strip within the side wall plane. In this manner, said inventive connecting portions facilitate not only a connection between two strips, but also a change in the distance between said strips.

In accordance with one aspect of the invention, the connecting segments are arranged on the strips in such a manner—in particular such that they are laterally offset in relation to same—that two strips located one above the other can be made to planarly abut in the second position, or in the fully compressed position, so that the height of the grid-like structure in the second, or compressed, position essentially corresponds to the sum of the section heights of all the strips. Advantageously, the connecting segments have the same wall thickness as the strips, or are formed by some kind of material tongues which are cut out from the strips and which in the second, or compressed, position planarly abut one above the other, or in a folded-up manner.

In accordance with one aspect, the at least one side wall may be formed by a frame element and by the grid-like structure arranged within the frame. Outer end portions of the strips may each be movably accommodated in a guide slot, respectively, within the corresponding portion of the frame element. That is, the outer ends of the strips are guided within slots of the frame element in the actuating or sliding direction. The frame element can be connected to the floor in the manner of being inwardly collapsible so as to return the container in a space-saving manner with all of the side walls inwardly collapsed in the empty state. The inventive display function does not restrict the collapsibility of the container thereto since the grid-like structure does not protrude beyond the side wall thickness, or frame thickness, of the side wall. Also, the stackability of the container is not impaired by the grid structure.

The overall width of the strips including the connecting portions is advantageously smaller than the wall thickness of the frame element or of the other side walls.

Alternatively, the at least one side wall may be formed by the grid-like structure alone, and the strips may be accommodated and guided within corresponding guides or slots in adjacent side walls. In this manner, the opening toward the entire side face is increased, or maximized.

In accordance with an advantageous implementation, notches may be provided on the inside of side edges of the floor, which notches are aligned with the guide slots of the adjacent side walls, so that the grid may be fully lowered down to the floor and the adjacent side walls can be inwardly collapsed over the compressed grid. Thus, collapsibility of the remaining side walls is facilitated even with a frameless display container.

In accordance with one aspect, the grid-like structure may be detachably lockable in a tool-less manner at least in the first, or upper, and/or the second, or lower, position, in particular by means of detent geometries. This is to ensure that, on the one hand, the grid remains in its respective position in an opened or closed state and can be moved to the respectively other position by simple handling, e.g. slight pressing or pulling. The elements in question may be detents which are located within the guide slots and which can overcome the outer ends of the strips in a resilient manner when a corresponding tensile or compressive force is applied.

In accordance with one aspect, the strips may be configured to be wavy, whereby the rigidity of the individual strips, or of the grid structure overall, may be increased in a direction perpendicular to the side wall area, or toward the outside and toward the inside.

In accordance with one aspect of the invention, the fully compressed or squeezed strips fully disappear, in the second position, behind a side edge of the floor or a floor-side portion of the frame element. This is to ensure that during loading and unloading of the container, the grid structure does not impede access to the interior of the container, on the one hand, and cannot be damaged, on the other hand. In addition, the grid thus also does not impair the visual appearance of the goods presented with the inventive container.

Further advantages result from the following description of an embodiment with reference to attached drawings.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
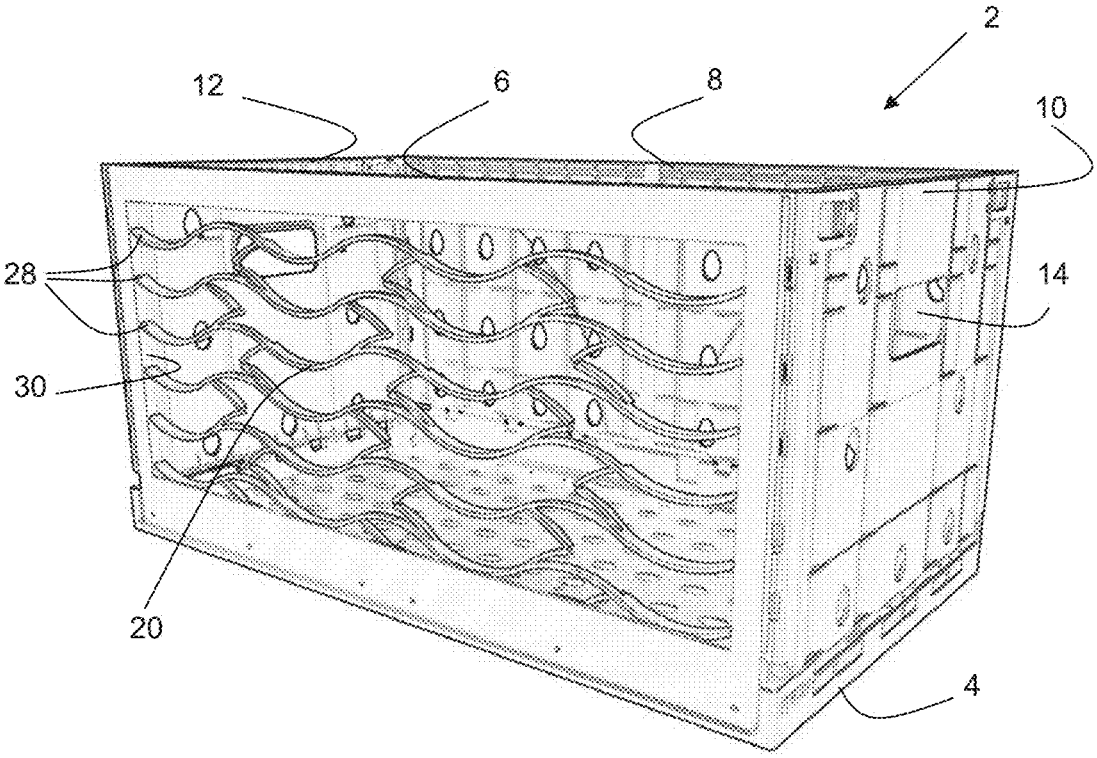
FIG. 1 shows a perspective view of a container in accordance with a first embodiment of the invention with a side wall in a first position.

FIG. 1 shows a container 2 in accordance with a first embodiment that is suitable for transporting and storing, in particular for presenting, goods. The container 2 comprises an essentially rectangular floor 4 which has side walls 6, 8, 10, and 12 provided on its outer edges, said side walls extending essentially perpendicularly upward and being connected to one another. The side walls 6 and 8 are long side walls, and the side walls 10 and 12 are the two short side walls. All four side walls 6, 8, 10, and 12 are connected to the floor 4 in an articulated manner and can be collapsed inwardly and one over the other. The short side walls 10 and 12 each comprise, in the center and in the upper area, a grip opening 14 for handling the container 2. Apart from that, the side walls 8, 10, and 12 are each provided with reinforcing ribs and venting openings.

Figure 2:
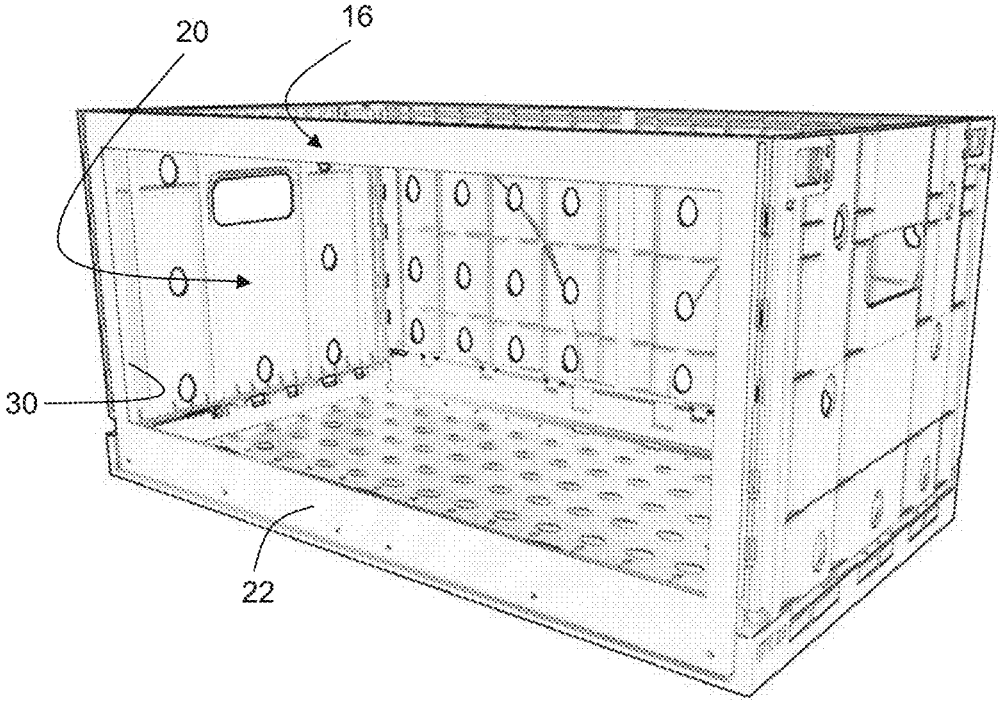
FIG. 2 shows the container in accordance with the first embodiment of the invention with the side wall in a second position.

While the rear long side wall 8 is a closed side wall except for the venting openings, the front long side wall 6 is formed by a frame 16 which defines the outer dimensions of the side wall 6 and via which the side wall 6 is connected, or connectable, to the floor 4 and the adjacent side walls 10 and 12. The frame 16 spans a large-area display opening 18 which can be closed (see FIG. 1) or opened (see FIG. 2) by a sliding grid, or a grid-like structure 20. In the opened, or second, position as is shown in FIG. 2, the grid 20 is located within a floor-side portion 22 of the frame 16, as can be seen in the perspective rear view of FIG. 3.

The grid structure 20 comprises several wavy strips 24 which are arranged one above the other, extend across the entire width of the display opening 18, or of the frame 16, and are connected to one another via a multitude of connecting portions 26. The respectively outer ends 28 of the strips 24 are vertically guided within slots 30 formed on the insides of vertical frame portions. The guide slots 30 may have detents (not represented in any more detail) formed therein in order to hold or lock the grid structure 20 in the first, or closed, or pulled-apart position shown in FIG. 1 and/or in the second, or opened, or compressed position shown in FIG. 2.

Figure 4:
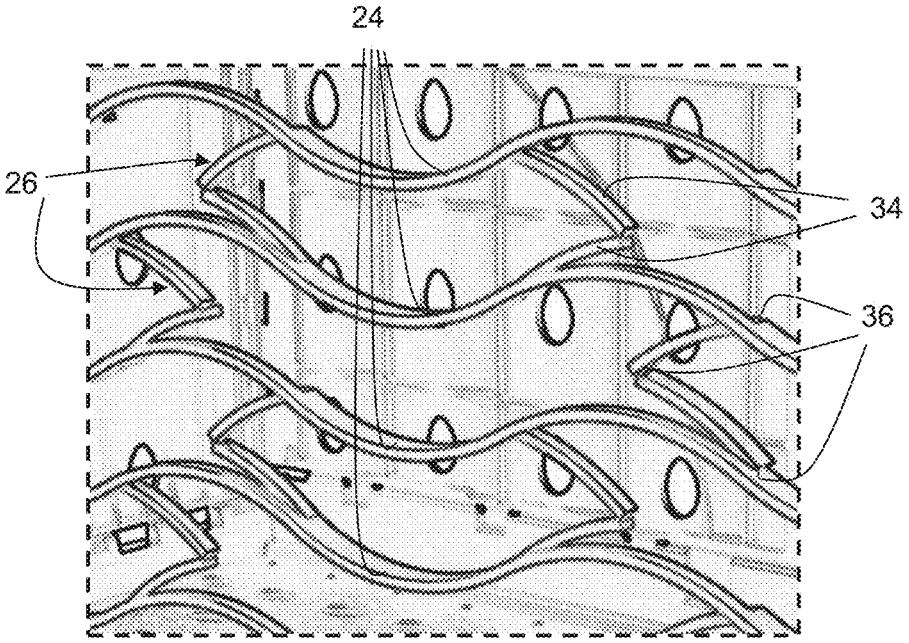
FIG. 4 shows a detailed section of FIG. 1.

FIG. 4 shows an enlarged detailed section of FIG. 1 for describing the design of the grid-like structure 20 in more detail therewith.

The connecting portions 26 each comprise two connecting segments 34 of essentially the same length which are connected to one another in an articulated manner via a living hinge 36, so that the connecting segments 34 may be folded up and folded apart within the plane of the side wall 6 in each case. On the side of the strips, the two connecting segments 34 are also connected to the respective strip 24 via corresponding living hinges 36. In this manner, two strips 24 arranged above each other can approach each other or move away from each other via the connecting portions 26 in the manner of a scissor hinge.

Figure 3:
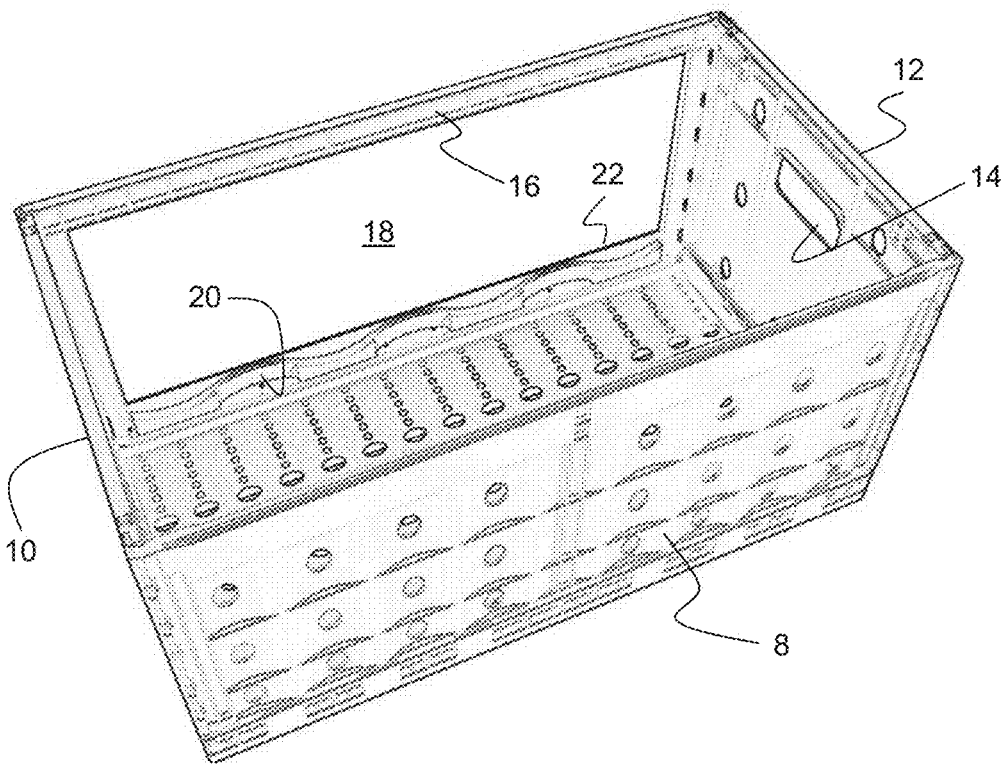
FIG. 3 shows a perspective view of the container in accordance with the first embodiment of the invention, with the side wall in the second position, in a rear view.

As can also be seen in FIG. 4, the connecting segments 34 essentially are material tongues of the respective strips 24 which may be swiveled upward and/or downward accordingly in relation to the strips 24 via the living hinges 36. Said connecting segments 34 are arranged laterally, more specifically inwardly, in relation to the strips 24, so that two strips 24 arranged above each other are made to fully abut in a planar manner when the grid 20 is fully compressed, as can be seen in FIG. 3. The connecting portions 26 will then be located laterally, more specifically inwardly, in relation to the strips 24 laid one above the other.

One may further see in FIG. 1 that a multitude of connecting portions 26, more specifically three connecting portions 26, are arranged between adjacent strips 24 and are more or less equally spaced apart from one another; those connecting portions 26 which connect the pair of strips 24 located below or above them are laterally offset from same. In this manner it is ensured that when being pulled apart, or squeezed together, the strips 24 are shifted in an essentially parallel manner and the grid 20 does not tilt so easily. This is enhanced, moreover, by the fact that the living hinges 36 located between the connecting segments 34 partly point to opposite directions.

For pulling the grid 20 apart or squeezing it together, the topmost strip 24 may be used.

Figure 5:
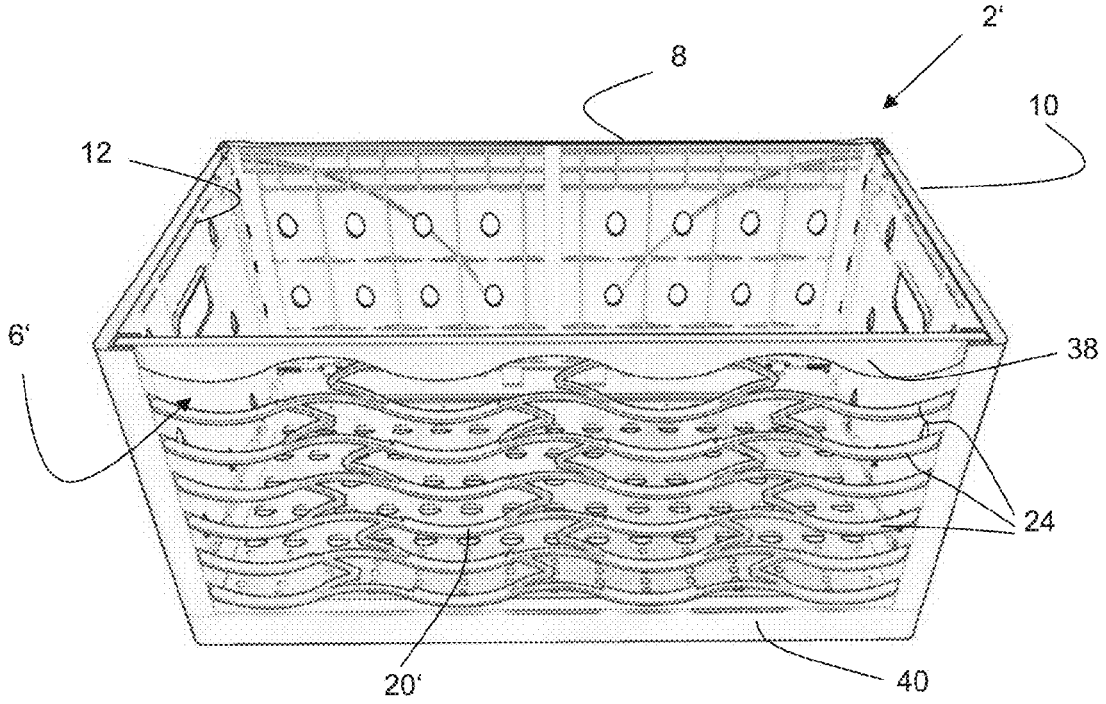
FIG. 5 shows a perspective view of a container in accordance with a second embodiment of the invention with a side wall in a first position.
Figure 6:
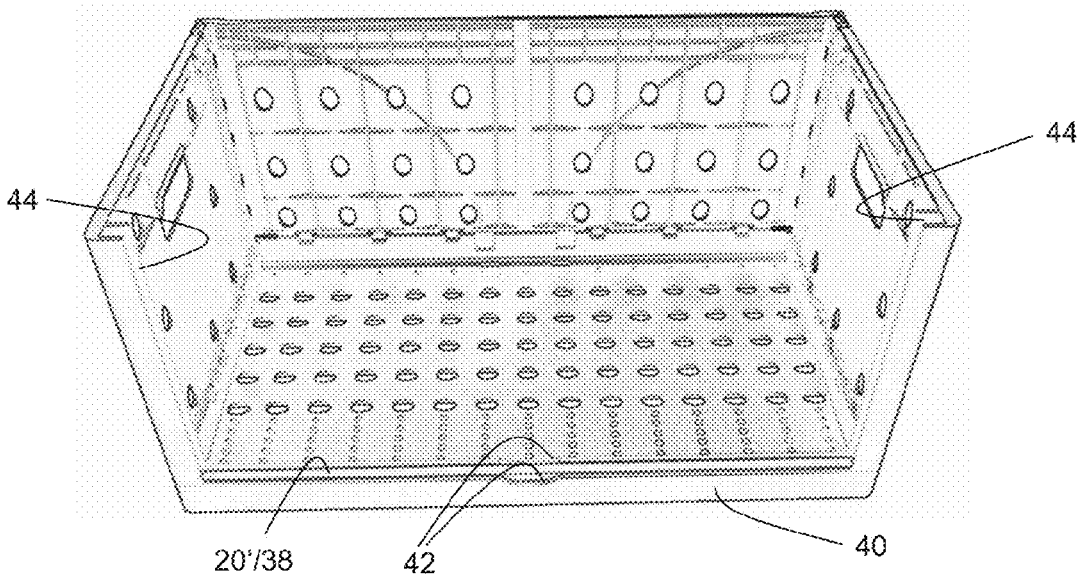
FIG. 6 shows the container in accordance with the second embodiment of the invention with the side wall in a second position.

In accordance with a second embodiment, shown in FIGS. 5 and 6, of a container 2', the topmost strip 24 is replaced by a reinforced end or handling strip 38 which also extends in the manner of a straight line, which at the top is flush with the upper edges of the adjacent side walls 10, 12 in the first, or closed, position as is shown in FIG. 5, and which is flush with a top side edge 40 of the floor 4 in the second, or open, position as is shown in FIG. 6. The side edge 40 of the floor 4 further comprises, in its center, small recesses or depressions 42 for being able to better grip the handling strip 38 in the second or lowered position.

The handling strip 38 may be integrally formed with the remaining elements of the grid structure (strips 24 and connecting portions 26). Alternatively, the handling strip 38 may be a separately produced component that is connected, or connectable, to the topmost strip 24 and/or to the topmost connecting portions 26, or that is connectable, in particular, in a detachable and/or tool-less manner, e.g., is clamped on.

In one variation of the second embodiment, the grid structure 20' may comprise an end strip on both sides, i.e., additionally also on the lower side.

While in the first embodiment, the grid structure 20 is accommodated and guided within a frame 16, the grid structure 20' in the second embodiment is accommodated and vertically guided directly within slots 44, which are formed on the inside of the side walls 10 and 12.

The rest of the design of the container 2' and in particular of the grid structure is similar to the first embodiment which is why reference is made in this respect to the explanations given on the first embodiment.

As an alternative to both embodiments presented above, the rear wall, or the side wall, 8 may also be designed similarly to the front side wall 6, or may also have a display opening 18 accessible via a grid structure. In the variation without the frame 16, the empty stacking height of the container 2 may be further reduced.

What was described is an embodiment of an inventive display container 2 as well as several variations, said display container 2 offering a considerably more space-saving solution, as compared to all of the swiveling, folding or roll-down systems, for safely transporting goods, on the one hand, and presenting them to the customers on the shelf on the spot, on the other hand. This is enabled by the above-described, integral grid structure 20 made of plastic, which may be fully squeezed together and thus allows reducing the height of the grid 20 to a minimum height, and which may be pulled apart so as to fully close the display opening 18. It shall be noted that the actuating direction of the inventive grid 20 may not only be the vertical direction but also the horizontal direction, i.e., to the left or to the right.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. Container for transporting and storing or presenting goods, comprising a floor which is essentially rectangular and side walls extending from the floor, wherein at least one of the side walls or a part thereof is formed by a structure having a grid shape, wherein the structure is extensible and compressible or able to be pulled apart or squeezed together in at least one direction and in a side wall plane so as to demarcate or to close the container toward the side in a first position and to release the container toward the side in a second position;

wherein the at least one side wall is formed by the structure alone, outer end portions of strips each being moveably accommodated within a guide slot of a correspondingly adjacent side wall; and wherein the structure is formed by a multitude of strips, which extend transversely to the one direction and run essentially in parallel with one another, and by at least a multitude of connecting portions connecting the multitude of strips in a direction different to the one direction so as to form the grid shape together with the strips.

2. Container as claimed in claim 1, wherein the structure is formed in one piece of plastic.

3. Container as claimed in claim 1, wherein the structure is formed by the multitude of strips and by the connecting portions arranged between the strips, the connecting portions being configured to be bendable or foldable within the side wall plane in such a manner that the distance between two adjacent strips is shortened.

4. Container as claimed in claim 3, wherein each connecting portion is formed by two connecting segments of two adjacent strips, which are connected via a living hinge.

5. Container as claimed in claim 3, wherein the strips planarly abut one above the other in the second position or fully compressed position of the structure and that connecting segments are arranged laterally in relation to the strips or each complete a corresponding strip.

6. Container as claimed in claim 1, wherein the at least one side wall is formed by a frame element foldably connected to the floor, and by the structure arranged within the frame, outer end portions of the strips being movably accommodated within the guide slot, respectively, within the frame element.

7. Container as claimed in claim 1, wherein the structure can be detachably locked in a tool-less manner by detent geometries, at least in the first and/or second position(s).

8. Container as claimed in claim 3, wherein the strips are configured to be wavy.

9. Container as claimed in claim 3, wherein in the second position, the compressed or squeezed-together strips are fully concealed behind a side edge of the floor or a floor-side portion of the frame element.

10. Container for transporting and storing or presenting goods, comprising a floor which is essentially rectangular and side walls extending from the floor, wherein at least one of the side walls or a part thereof is formed by a structure having a grid shape, wherein the structure is extensible and compressible or able to be pulled apart or squeezed together in at least one direction and in a side wall plane so as to demarcate or to close the container toward the side in a first position and to release the container toward the side in a second position;

wherein the at least one side wall is formed by the structure alone, outer end portions of strips each being moveably accommodated within a guide slot of a correspondingly adjacent side wall;

wherein the structure is formed by a multitude of strips, which extend transversely to the one direction and run essentially in parallel with one another, and by connecting portions arranged between the strips, the connecting portions being configured to be bendable or foldable within the side wall plane in such a manner that the distance between two adjacent strips are shortened; and wherein each connecting portion is formed by two connecting segments of two adjacent strips, which are connected via a living hinge, or wherein the strips are configured to be wavy or wherein in the second position, the compressed or squeezed-together strips are fully concealed behind a side edge of the floor or a floor-side portion of the frame element.

* * * * *